United States Patent [19]

Kemori et al.

[11] Patent Number: 4,848,754

[45] Date of Patent: Jul. 18, 1989

[54] FLASH SMELTING FURNACE

[75] Inventors: Nobumasa Kemori; Yasuo Ojima; Yasuhiro Kondo, all of Niihama City, Japan

[73] Assignee: Sumitomo Metal Mining Company Ltd., Tokyo, Japan

[21] Appl. No.: 197,967

[22] Filed: May 24, 1988

[30] Foreign Application Priority Data

Mar. 31, 1988 [JP] Japan ..... 63-80038

[51] Int. Cl.[4] ..... C22B 9/16

[52] U.S. Cl. ..... 266/162; 266/172; 266/202

[58] Field of Search ..... 266/202, 161, 162, 171, 266/172, 200

[56] References Cited

U.S. PATENT DOCUMENTS

| | | | |
|---|---|---|---|
| 4,017,307 | 4/1977 | Winterhayer et al. | 266/162 |
| 4,027,863 | 6/1977 | Aaltonen et al. | 266/162 |
| 4,088,310 | 5/1978 | Noponen et al. | 266/161 |

*Primary Examiner*—S. Kastler

*Attorney, Agent, or Firm*—Watson, Cole, Grindle & Watson

[57] ABSTRACT

A flash smelting furnace includes a reaction shaft defining a reaction chamber therein, a plurality of reaction air blowing pipes passing through the side wall of the reaction shaft for blowing reaction air into the reaction chamber, and at least one concentrate burner attached to the top end of the reaction shaft and comprising a concentrate chute, a tubular auxiliary fuel burner extending vertically through the chute, a tubular oxygen blowing pipe concentrically surrounding the auxiliary fuel burner and a dispersion cone attached to the lower end of the oxygen blowing pipe. The air from the blowing pipes disturbs the jet stream of mixed smelting material and reaction gas in the reaction chamber, thereby achieving a uniform mixture of the material and the reaction air and extending the retention time of the material in the reaction shaft.

4 Claims, 3 Drawing Sheets

PRIOR ART

FLASH SMELTING FURNACE

BACKGROUND OF THE INVENTION

The present invention relates to a flash smelting furnace for producing matte as an intermediate smelted product from copper or nickel sulphide ores.

DESCRIPTION OF PRIOR ART

One type of smelting furnaces which uses sulphide concentrates as a raw material is a flash smelting furnace. As shown in FIG. 4, a conventional flash smelting furnace 1 consists essentially of a reaction shaft 3 provided with a concentrate burner 2, a settler 6 which is connected at one end to the lower part of the reaction shaft 3 and is provided with a slag outlet 4 a and matte hole 5 formed on the side wall thereof, and an uptake 7. The smelting process conducted in this furnace is such that a smelting material 8, such as sulphide concentrates, flux and supplemental fuel is first blown from the concentrate burner 2 into the reaction shaft 3 of the furnace together with preheated reaction air 9. Then part of the sulfur and iron, which are combustible constituents of the smelting material 8, reacts with the hot reaction air 9 within the reaction shaft 3, yielding $SO_2$ gas, iron oxides and reaction heat. The oxidized material falling through the reaction shaft 3, becomes molten due to the reaction heat and then is pooled in the settler 6. In the settler 6, the molten oxidized material 8 is separated into a matte 10 as a mixture of $Cu_2S$ and FeS and a slag 11 consisting mainly of $2FeO.SiO_2$. The slag 11 is discharged from the slag outlet 4 and introduced into an electric slag cleaning furnace 12 while the matte 10 is tapped from the matte hole 5 according to the operating cycle of converters.

Further, a hot waste gas 13 generated in the reaction shaft 3 is cooled by a boiler 14 after passing through the settler 6 and uptake 7. The slag in the electric slag cleaning furnace 12 is kept heated by electrodes 15. Since the matte particles entrained in the slag are settled down on the bottom of the furnace by natural settling and adding the massive ore or flux. Therefore only the slag containing a slight amount of copper is discharged outside the furnace through an outlet 16.

In the case of such a flash smelting furnace, it is necessary for the oxidation reaction to be completed while the smelting material falls down in the reaction shaft. When the reaction is not complete, a part of the unreacted material is entrained in the hot waste gas 13 and becomes flue dust, which is accumulated in the boiler 14. The other part thereof is accumulated on the surface of the melt under the reaction shaft 3. The flue dust accumulated in the boiler 14 is collected and recycled in the flash furnace or the converter, but when the amount of flue dust increases, the supplemental fuel for melting it has to be increased, resulting in an economic disadvantage. Further, the flue dust fixed to the boiler 14 increases and not only lowers the efficiency of heat transfer of the boiler 14 but also increases the danger of damaging the boiler due to its falling off. The undissolved part of the material accumulated on the surface of the melt prevents the generation of the matte 10 and sharply fluctuates the temperature or grade of the matte, thereby making it difficult to operate the furnace.

To avoid such a situation, it is necessary to uniformly mix the smelting material and the reaction air within the reaction shaft so as to allow the mixture to stay within the reaction shaft for a sufficient time to complete the oxidation reaction, but it has not been possible to achieve this in the conventional smelting furnace. The reason for this is that in order to obtain a uniform mixture of the smelting material and the reaction air, the reaction air must be blown against the smelting material falling down from the concentrate chute at a blowing speed higher than a predetermined value, and as a result the smelting material is distributed only in a jet stream formed by the concentrate burner and so the retention time of the smelting material in the reaction shaft is unconditionally determined by the height of the reaction shaft and the blowing speed of the reaction air. Consequently, it is not possible to control the blowing speed of the reaction air and the retention time of the smelting material simultaneously and it has been usual that only the reaction air blowing speed is controlled by a control device and due consideration has not been paid to the retention time of the smelting material within the reaction shaft.

Further, in the case where oxygen-enriched air is used for increasing the smelting rate or saving energy costs, the conventional smelting furnace becomes much more unsatisfactory.

In order to mix the smelting material and reaction air uniformly, it is considered necessary to make the reaction air blowing speed higher than 80 m/sec. In this connection, the conventional concentrate burner 25 has been constructed such that a tubular concentrate chute 18 is mounted so as to be suspended vertically along the center axis of a burner body 17, which has its lower part formed in the shape of a venturi, while the lower end of the chute projects slightly downwardly beyond the venturi-like drawn section 19 of the burner body 17, and an auxiliary fuel burner 20 is mounted to extend vertically along the center axis of the concentrate chute 18 so that reaction air 9 supplied through an air duct 21 is blown through the drawn section 19 against the smelting material falling down in the concentrate chute 18. However, the concentrate burner of this structure has had the disadvantage that the area of opening of the venturi-like drawn section 19 defined by the clearance between the narrowest inner wall of the burner body 17 and the outer periphery of the concentrate chute 18 is constant, and therefore, the feeding amount of the reaction air 9 for obtaining the blowing speed required for achieving the above-mentioned uniform mixing is limited to a narrow range. Especially where oxygenated air is used, the amount of the reaction air varies sharply depending on the degree of oxygenation of the air, and the operation of the furnace has been limited in the way of selecting the degree of oxygenation of the air due to the limitation on the blowing speed of the reaction air.

As a means for eliminating the above-mentioned disadvantages of the conventional smelting furnace, there have been disclosed an apparatus for keeping the suitable blowing speed of reaction air at the venturi-like drawn section 19 by the attachment of a cone 23 to that section (See Japanese Laid-Open Utility Model Publication No. 60-38665) and an apparatus for improving the diffusibility of the smelting material by premixing the material with technical grade oxygen (Japanese Patent Publication No. 59-41495). However, the former has the disadvantage that there is a great pressure loss with respect to an increase in the amount of air so that it is necessary to excessively increase the pressure of the fan. This is disadvantageous in that if the amount of technical grade oxygen to be mixed with the smelting material is increased, the material is blown upward within the concentrate chute 18, while if decreased, there arises not only a danger of generation of a backfire but also a possibility that reactions take place at the lower end of the concentrate chute 18 in the burner cone 22, thereby blocking the chute 18.

Further, although the above-mentioned speed-regulating cone has made it possible to uniformly mix the smelting material and the reaction air by making the blow speed of the reaction air higher than 80 m/sec, since the smelting material is distributed in the jet stream formed by the concentrate burner, the retention time of the material within the reaction shaft is so short that the temperature of the smelting material can not be increased to a sufficient degree, resulting in incomplete oxidation and melting reactions and a high flue dust generation.

SUMMARY OF THE INVENTION

The present invention has been made to eliminate the above-mentioned problems involved in the conventional flash smelting furnace and to provide an improved flash smelting furnace which is capable of securing a uniform mixture of the smelting material and reaction air and a sufficient retention time of the material within the reaction shaft, thereby completing the oxidation and melting reactions of the material and air within the reaction shaft.

DETAILED DESCRIPTION OF THE INVENTION

Figure 1:
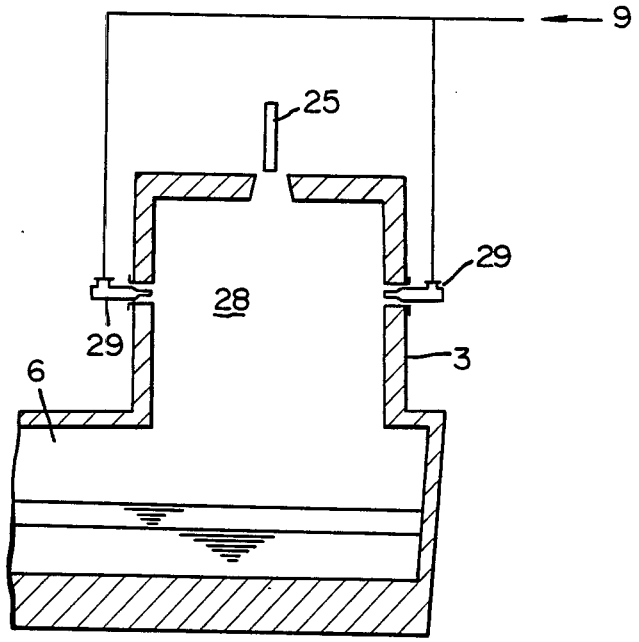
FIG. 1 is a view (partially in section) illustrating one embodiment of a flash smelting furnace according to the present invention.

One embodiment of the present invention will now be described with reference to the accompanying drawings, wherein like parts are designated by like reference numerals.

Figure 2:
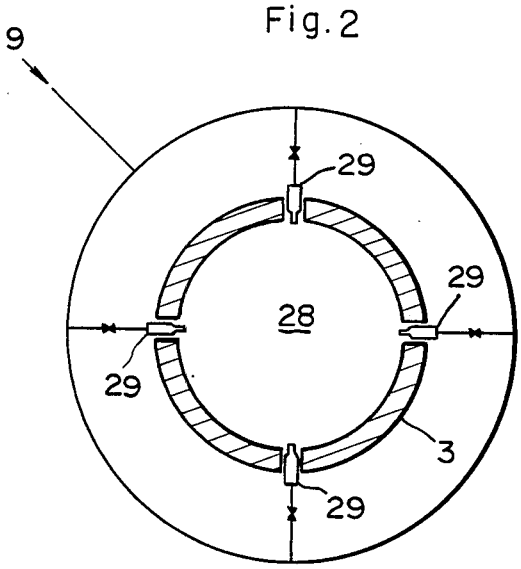
FIG. 2 is a partial sectional view of a reaction shaft shown in FIG. 1.
Figure 3:
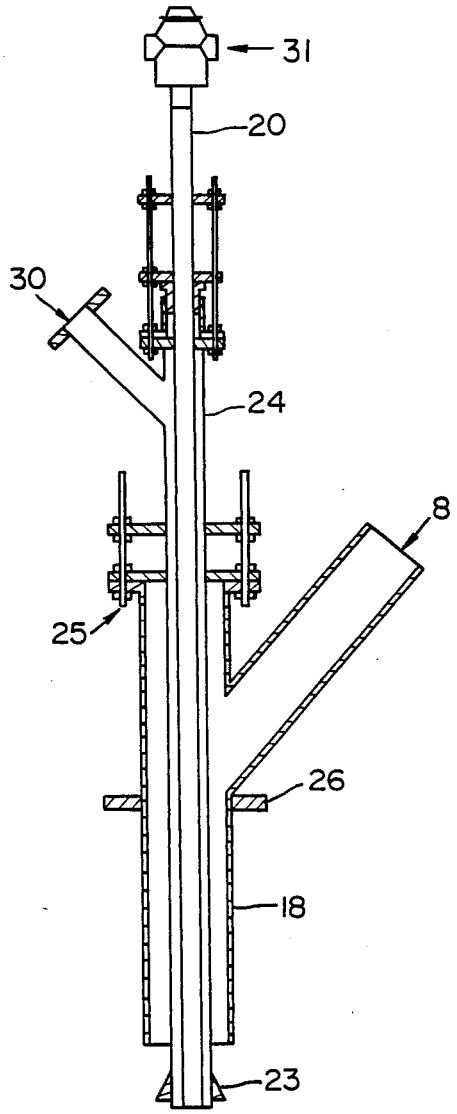
FIG. 3 is a sectional view of a concentrate burner of the flash smelting furnace shown in FIG. 1.
Figure 4:
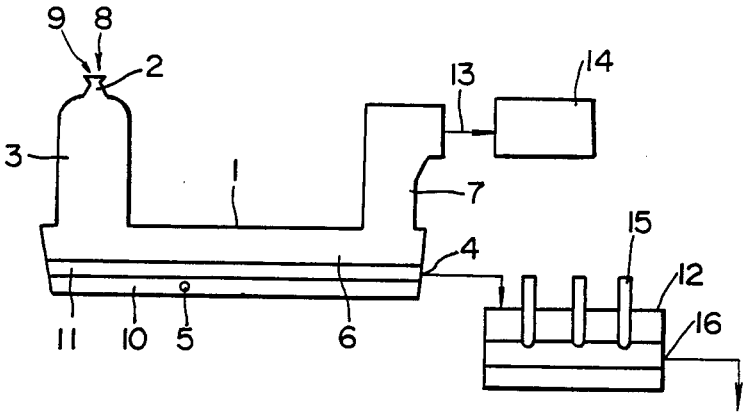
FIG. 4 is an illustrative view of a flash smelting furnace in general use.

Referring to FIGS. 1 through 3, a flash smelting furnace 1 comprises a reaction shaft 3 provided with at least an air blowing pipe 29 arranged to pass through the side wall of the reaction shaft 3 so as to blow reaction air 9 into a reaction chamber 28 of the reaction shaft 3, a concentrate chute 18, an auxiliary fuel burner 20 extending vertically along the center axis of the concentrate chute 18, with its lower end projecting downwardly beyond the lower end of the concentrate chute, at least one concentrate burner 25 attached to the top end of the reaction shaft 3 and comprised of an oxygen blowing pipe 24 arranged in concentrical relationships with and between the concentrate chute 18 and the auxiliary fuel burner 20, with its lower end being held substantially level with the lower end of the auxiliary burner 20, and a dispersion cone 23 attached to the outer periphery of the lower part of the oxygen blowing pipe 24.

Figure 5:
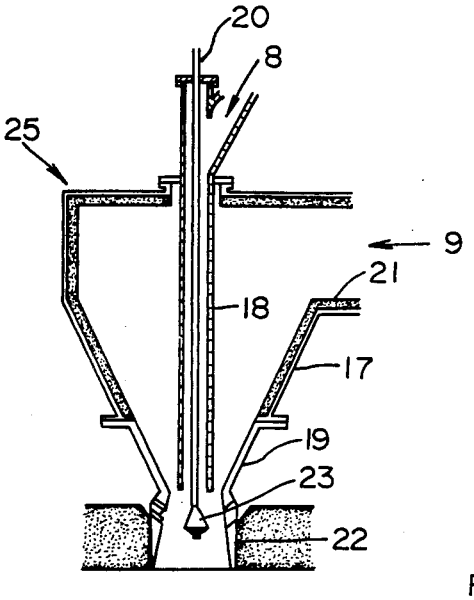
PRIOR ART Fig. 5
FIG. 5 is a sectional view of a conventional concentrate burner.

The flash smelting furnace according to the present invention operates such that since the air blowing pipe 29 is provided through the side wall of the reaction shaft so as to blow reaction air into the reaction chamber 28 of the reaction shaft 3, even when the conventional concentrate burner 25 shown in FIG. 5 is used, a jet stream of a mixture of the smelting material 8 and the reaction air 9 produced within the reaction shaft 3 by the concentrate burner 25 is disturbed so that the stream spreads throughout the reaction shaft 3 in a turbulent flow. As a result, not only the smelting material 8 and the reaction air 9 are more uniformly mixed with each other but also the retention time of the mixture within the reaction chamber of the reaction shaft 3 becomes longer, and it is further possible to perform a suitable smelting operation in a wide range of the degree of oxygenation of the reaction air 9.

Further, the use of the concentrate burner according to the present invention is accompanied with such advantages that since the lower end of the oxygen blowing pipe and the lower end of the auxiliary burner are located below the lower end of the concentrate chute, the jumping of a backfire into the concentrate chute and the blowing up of the smelting material toward the upper part of the concentrate chute are prevented and no adhesion of a melt or half-melt to the lower end of the concentrate chute takes place. However, the use of only such a concentrate burner is not always sufficient to obtain a suitable mixture of the smelting material and reaction air to a sufficient retention time of the mixture in the reaction shaft and therefore, the air blowing pipe is additionally provided to satisfy these requirements.

The oxygen 30 is blown from the oxgyen blowing pipe of the concentrate burner and the air or oxygenated air is blown from the air blowing pipe. Further, a plurality of air blowing pipes may be provided around the side wall of the reaction shaft depending on the size and operating conditions of the reaction shaft.

EXPERIMENTS

For comparison purposes, experiments were conducted on the flash smelting furnace according to the present invention shown in FIGS. 1 and in 2 and the conventional flash smelting furnace shown in FIG. 5, with the results shown below.

The furnace of the present invention used in the experiments had a reaction shaft 3 having a diameter of 1.5 m and a height of 3.4 m and a settler 6 of 6 m in length. Further, a total of four air blowing pipes 29 were arranged around the side wall of the reaction shaft 3 at equal intervals and at a height equal to half the height of the reaction shaft so that reaction air could be blown into the central portion of the reaction shaft 3. Moreover, at the center of the top of the reaction shaft 3 there was attached a concentrate burner 25 like that shown in FIG. 3. The concentrate burner 25 comprised a tubular concentrate chute 18, a tubular auxiliary burner 20 extending vertically through the center of the concentrate chute 18 with its lower end projecting downwardly beyond the lower end of the chute 18, an oxygen blowing pipe 24 arranged concentrically with and between the concentrate chute 18 and the auxiliary burner 20, with its lower end substantially level with the lower end of the auxiliary burner, and dispersion cone 23 attached to the outer periphery of the lower end of the oxygen blowing pipe 24. Further, the concentrate burner was attached to the top of the reaction shaft 3 by means of a flange 26 fixed to the intermediate portion of the outer periphery of the concentrate chute 18. On the other hand, the conventional smelting furnace had the same size as the above furnace but it had only the concentrate burner attached to the top end thereof. The two furnaces were operated under the operating conditions shown in the following table 1 for a period of 14 days with results shown in Table 2.

TABLE 1

| Items | | Conventional type | Furnace of the present invention |
|---|---|---|---|
| Processing amount of dry ore | t/H | 0.9 | 0.9 |
| Contents: | | | |
| copper concentrate | t/H | 0.8 | 0.8 |
| flux | t/H | 0.1 | 0.1 |
| Amount of shaft heavy oil | l/H | 23 | 23 |
| Amount of reaction air to concentrate burner | $Nm^3/H$ | 500 | 120 |
| Oxygen concentration of reaction air | % | 38 | 90 |
| Reaction air temp. | °C. | 20 | 20 |
| Amount of reaction air to blowing pipe | $Nm^3/L$ | 0 | 380 |
| Oxygen concentration of reaction air | % | — | 21 |
| Reaction air temp. | °C. | — | 20 |
| Blowing speed | m/sec | — | 100 |

TABLE 2

| Items | | Conventional type | Furnace of the present invention |
|---|---|---|---|
| Amount of yield of matte | t/H | 0.30 | 0.30 |
| Amount of yield of slag | t/H | 0.34 | 0.35 |
| Melt temp. | | | |
| Matte | °C. | 1180 | 1180 |
| Slag | °C. | 1250 | 1240 |
| Rate of generation of flue dust | % | 14.5 | 7.0 |
| Grade of copper in slag | % | 1.20 | 1.15 |
| Grade of matte | % | 67 | 75 |

From Table 2, it will be understood that in the case of the furnace of the present invention, the amount of flue dust is small as compared to that in the case of the conventional furnace and that the grade of copper in the slag is lower than that in the case of the latter.

As described above, it is possible with the present invention to perform the reaction of a concentrate with reaction air to a sufficient degree within the reaction shaft with a minimum amount of flue dust and to prevent accidents or failures with respect to the concentrate burner.

What is claimed is:

1. A flash smelting furnace which comprises:

a reaction shaft which has a top end and a side wall and which provides a reaction chamber therein, a concentrate burner attached to the top of said reaction shaft, said concentrate burner including a concentrate chute for supplying a smelting material into said reaction chamber, said concentrate chute having a lower end and defining a vertical central axis, an oxygen blowing pipe for blowing oxygen into said reaction chamber, said oxygen blowing pipe extending along said vertical central axis within said tubular concentrate chute and having a lower end which is below said lower end of said elongated concentrate chute, a tubular auxiliary fuel burner for supplying fuel into said reaction chamber, said tubular auxiliary fuel burner extending concentrically within said oxygen blowing pipe and having a lower end which is substantially level with the lower end of said oxygen blowing pipe, and a dispersion cone attached to the lower end of said oxygen blowing pipe, and a plurality of air blowing pipes located in said side wall of said reaction shaft for discharging air into said reaction chamber and into smelting material and reaction air descending therein.

2. The flash smelting furnace according to claim 1, wherein said top end of said reaction shaft has a center, and wherein said concentrate burner is attached to the top end of said reaction shaft at substantially said center thereof.

3. The flash smelting furnace according to claim 1, wherein said reaction shaft defines a vertical height and a vertical axis, and wherein said plurality of air blowing pipes are arranged around said side wall of said reaction shaft at equal intervals at a height substantially equal to half said vertical height.

4. The flash smelting furnace according to claim 3, wherein each air blowing pipe of said plurality of air blowing pipes is directed towards said vertical axis.

* * * * *